US005156125A

United States Patent [19]

Fukui et al.

[11] Patent Number: 5,156,125

[45] Date of Patent: Oct. 20, 1992

[54] ENGINE CONTROL APPARATUS

[75] Inventors: Wataru Fukui; Toshio Iwata, both of Himeji, Japan

[73] Assignee: Mitsubishi Denki Kabushiki Kaisha, Tokyo, Japan

[21] Appl. No.: 772,709

[22] Filed: Oct. 7, 1991

[30] Foreign Application Priority Data

Oct. 11, 1990 [JP] Japan ..... 2-270618
Oct. 11, 1990 [JP] Japan ..... 2-270619
Oct. 11, 1990 [JP] Japan ..... 2-270620

[51] Int. Cl.[5] ..... F02P 7/067; F02P 5/15; F02D 41/34

[52] U.S. Cl. ..... 123/414; 123/416; 123/478

[58] Field of Search ..... 123/414, 416, 417, 478, 123/480, 612, 617; 73/116, 117.3; 364/431.04, 431.05

[56] References Cited

U.S. PATENT DOCUMENTS 4,309,973 1/1982 Tamura ..... 123/609
4,355,613 10/1982 Rode et al. ..... 123/417 X
4,553,426 11/1985 Capurka ..... 123/414 X
4,553,427 11/1985 Kuraoka et al. ..... 123/414 X
4,644,917 2/1987 Yakuwa et al. ..... 123/414
4,787,354 11/1988 Wilens et al. ..... 123/417 X
4,797,827 1/1989 Cockerham ..... 123/414 X
4,899,281 2/1990 Grimaud et al. ..... 123/417 X
4,941,445 7/1990 Deutsch ..... 123/414
5,041,979 8/1991 Hirka et al. ..... 123/414 X
5,054,447 10/1991 Fukui et al. ..... 123/414

*Primary Examiner*—Tony M. Argenbright
*Attorney, Agent, or Firm*—Sughrue, Mion, Zinn, Macpeak and Seas

[57] ABSTRACT

A control apparatus for an engine has a crankshaft position sensor that generates an output signal indicating the rotational position of a crankshaft. The output signal has at least one discontinuous portion per rotation of the crankshaft indicating a reference position of the crankshaft. The timing of an engine operating parameter such as the timing of fuel injection or ignition is calculated and controlled so as to occur with the calculated timing using the reference position as a reference. A camshaft position sensor senses the rotation of a camshaft and generates a signal having pulses occurring between consecutive occurrences of the reference position. The cylinders of the engine are identified by counting the number of pulses occurring between the reference positions.

17 Claims, 10 Drawing Sheets

ENGINE CONTROL APPARATUS

BACKGROUND OF THE INVENTION

This invention relates to a control apparatus for controlling an operating parameter such as the ignition timing or the fuel injection timing of an internal combustion engine. More particularly but not exclusively, it relates to a control apparatus for an engine of an automobile.

In order to operate an internal combustion engine efficiently, it is necessary that fuel injection and fuel ignition in each cylinder take place with a prescribed timing. Therefore, engines are typically equipped with position sensors for sensing the position with respect to top dead center of each piston of the engine. A commonly used position sensor senses the rotation of a member, such as the camshaft of the engine, which rotates at one-half the rotational speed of the crankshaft and generates a corresponding output signal which indicates not only the rotational position of the crankshaft but also which piston of the engine is in a prescribed position. However, the camshaft is driven by the crankshaft through a mechanical transmission system comprising drive belts, timing chains, or the like. If slippage occurs in the mechanical transmission system, a phase difference can occur between the rotational position sensed by the position sensor and the actual rotational position of the crankshaft. Therefore, if the output signal of the position sensor is employed to control the engine timing, fuel injection and ignition may not take place with the proper timing, and optimal engine performance can not be obtained.

SUMMARY OF THE INVENTION

Accordingly, it is an object of the present invention to provide an engine control apparatus which is not influenced by slippage between the crankshaft and camshaft of an engine.

It is another object of the present invention to provide an engine control apparatus which can properly control the engine timing even when the engine rotational speed is in transition.

It is another object of the present invention to provide an engine control method which can accurately control the timing of an engine.

An engine control apparatus according to the present invention includes a crankshaft position sensor for sensing the rotational position of a crankshaft of an engine and position sensing means for sensing the rotational position of a member that rotates at half the speed of the crankshaft. The crankshaft position sensor generates a signal having a discontinuous portion that identifies a prescribed reference position of the crankshaft. The position sensing means generates an output signal having pulses occurring between consecutive discontinuous portions in the output signal of the crankshaft position sensor. A cylinder identification means identifies the cylinders of the engine based on the output signal of the cylinder identification means generated between consecutive discontinuous portions. A control position for an operating parameter of the engine, such as the timing of fuel injection or fuel ignition, is calculated based on an operating condition of the engine, and the operating parameter is controlled according to the calculated control position using the reference position of the crankshaft as a reference.

In preferred embodiments, the output signal of the crankshaft position sensor comprises a series of pulses. The discontinuous portion may comprise a gap between consecutive pulses, the gap having a length different from the length of the normal interval between pulses. Alternatively, the discontinuous portion may comprise a pulse having a pulse width different the pulse width of normal pulses. The output signal may include more than one type of discontinuous portion.

DESCRIPTION OF THE PREFERRED EMBODIMENTS

Figure 1:
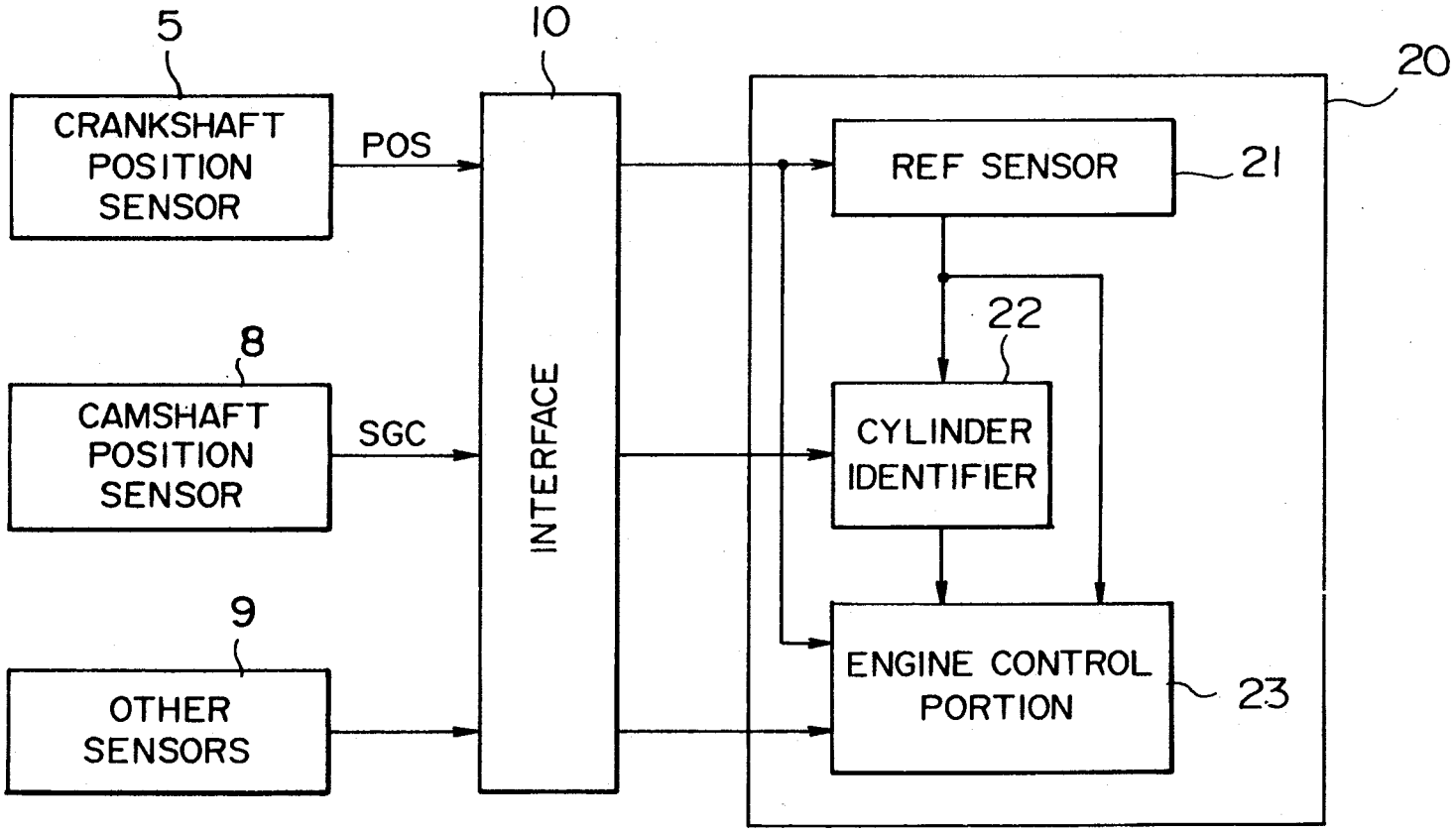
FIG. 1 is a block diagram of a first embodiment of a control apparatus according to the present invention.
Figure 2:
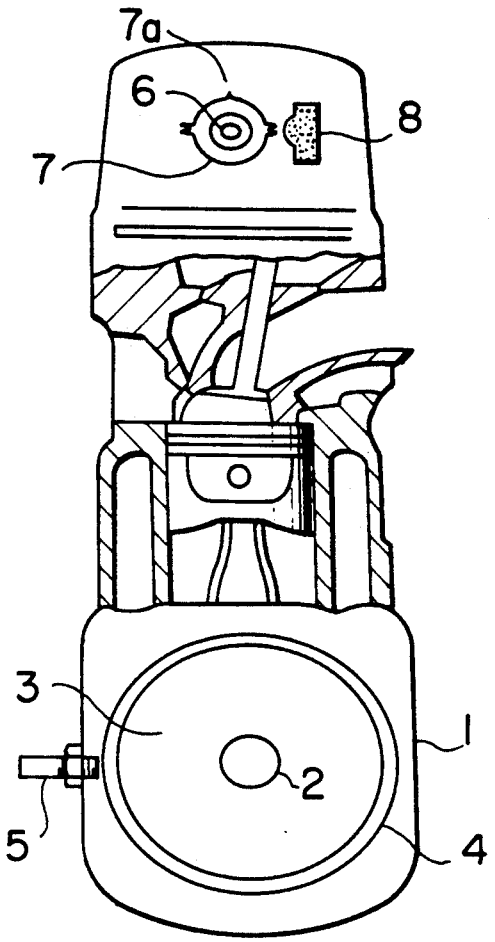
FIG. 2 is a partially cross-sectional schematic elevation of an engine employing the embodiment of FIG. 1.
Figure 3:
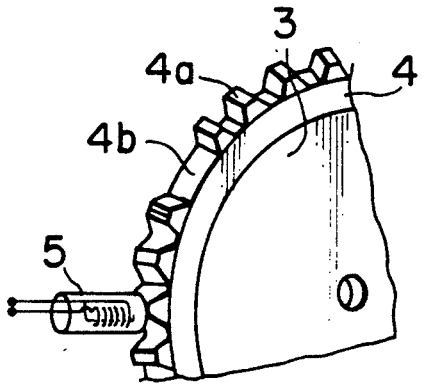
FIG. 3 is a schematic perspective view of a portion of a flywheel of the engine of FIG. 2.

A number of preferred embodiments of an engine control apparatus according to the present invention will now be described while referring to the accompanying drawings. FIG. 1 is a block diagram of a first embodiment, and FIG. 2 is a schematic elevation of an engine equipped with this embodiment. The case will be described in which the engine is a four-cycle engine with 4 cylinders, but the present invention is not limited to a four-cycle engine or to an engine having any particular number of cylinders. The engine 1 has a crankshaft 2 drivingly connected to the pistons of the four cylinders (only one of which is shown). A flywheel 3 is secured to the crankshaft 2 for rotation therewith, and a crankshaft position sensor 5 is mounted on the engine 1 in the vicinity of the crankshaft 2 for sensing the rotation of the crankshaft 2 and generating an output signal (referred to as a POS signal) from which the rotational position of the crankshaft 2 can be determined. Any device which can generate an output signal indicating when the crankshaft position is such that a piston in a cylinder of the engine is at a prescribed position with respect to top dead center can be used as the crankshaft position sensor 5. In the present embodiment, the flywheel 3 is equipped with a ring gear 4 having a plurality of teeth 4*a*, and the crankshaft position sensor 5 is an electromagnetic sensor which is disposed in the vicinity of the ring gear 4 and which generates an electrical pulse each time one of the teeth 4*a* of the ring gear 4 passes by the sensor 5. FIG. 3 shows the crankshaft position sensor 5 and a portion of the flywheel 3 and the ring gear 4 in greater detail. The teeth 4*a* of the ring gear 4 are disposed at uniform intervals around the periphery of the ring gear 4 except at one or more locations on the periphery where a gap 4*b* is formed between adjacent teeth, the size of the gap 4*b* being different from the spacing between adjacent teeth in portions of the ring gear 4 where no gap 4*b* is present. In the present embodiment, the gap 4*b* is larger than the normal interval between adjacent teeth 4*a*, but it is instead possible for it to be smaller. The gap 4*b* can be produced by removing one of the teeth 4*a* from the ring gear 4, for example. The number of gaps 4*b* is not critical. In the present embodiment, the number of gaps 4*b* is set equal to the number of cylinders n in the engine divided by 2, which in the case of a four-cylinder engine is $4/2=2$ gaps. The gaps 4*b* are equally spaced around the periphery of the ring gear 4.

The engine is also equipped with a camshaft 6 which rotates at one-half the speed of the crankshaft 2. A camshaft position sensor 8, such as an electromagnetic sensor, is disposed in the vicinity of the camshaft 6 for sensing the rotation of the camshaft 6 and generating an output signal (referred to as an SGC signal) from which the rotational position of the camshaft 6 and the position of the piston in each cylinder of the engine 1 can be determined. The camshaft position sensor 8 senses the movement of a plurality of projections 7*a* formed on the outer periphery of a rotating disk 7 secured to the camshaft 6 and generates a pulse each time one of the projections 7*a* passes by it. Camshaft position sensors are well known in the art, so a detailed description of the structure of sensor 8 will be omitted.

Instead of sensing the rotation of the camshaft 6, it is possible to sense the rotation of another member which rotates at one-half the speed of the crankshaft 2, such as the rotating shaft of a distributor for the engine 1. Sensors for sensing the rotation of a distributor shaft are also well know in the art, and any conventional type can be employed.

Figure 4:
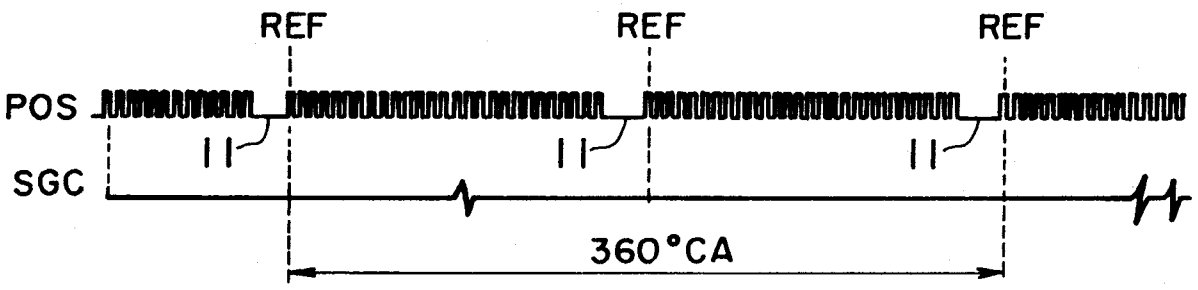
FIG. 4 is a wave form diagram of the output signals of the crankshaft position sensor and the camshaft position sensor of FIG. 1.

FIG. 4 is an example of the output signals of the crankshaft position sensor 5 (the POS signal) and the camshaft position sensor 8 (the SGC signal) of FIG. 2. The POS signal comprises a series of substantially uniform pulses which alternate between a high level and a low level and correspond to the teeth 4*a* of the ring gear 4. The period between the pulses is not critical, and will depend on the number of teeth on the ring gear 4. For a typical ring gear, the period is generally about 2 degrees of crankshaft rotation. At uniform intervals, the POS signal has discontinuous portions in the form of gaps 11 between pulses, the gaps 11 corresponding to the gaps 4*b* in the outer periphery of the ring gear 4. The crankshaft position sensor 5 is designed so that the POS signal has a low level in the gaps 11, but it is possible to reverse the polarity so that the signal level is high during the gaps 11. The rising edge of a pulse at the end of each gap 11 in the POS signal indicates a reference position (referred to as a REF position) of the crankshaft 2 which occurs each time a piston in one of the cylinders of the engine is at a prescribed position with respect to top dead center. As also shown in FIG. 4, the SGC signal comprises pulses which occur when the projections 7*a* of the rotating disk 7 pass by the camshaft position sensor 8. The rotating disk 7 is mounted o the camshaft 6 such that the pulses of the SGC signal occur between consecutive REF positions. The number of pulses in the SGC signal is different for each cylinder, so that by counting the number of pulses occurring between consecutive REF positions, it is possible to identify each cylinder of the engine.

The engine 1 is also equipped with one or more other sensors 9 (not shown in FIG. 2) which sense various operating parameters, such as the air intake rate into the engine, the degree of opening of a throttle valve, and the pressure within an air intake manifold and generate corresponding electrical output signals.

The output signals of the crankshaft position sensor 5, the camshaft position sensor 8, and the other sensors 9 are input to a control unit 20 via an interface 20. The control unit 20, which preferably comprises a microcomputer, is conceptually illustrated in FIG. 1 as including a REF sensing portion 21, a cylinder identification portion 22, and an engine control portion 23. The REF sensing portion 21 receives the POS signal from the crankshaft position sensor 5, senses the REF position, and generates an output signal indicating the occurrence of the REF position. The cylinder identification portion 22 receives the SGC signal from the camshaft position sensor 8 and the output signal from the REF sensing portion 21, determines which cylinder is in a prescribed stroke (such as which cylinder is presently in its compression stroke), and generates an output signal identifying this cylinder. The engine control portion 23 receives the output signals from the crankshaft position sensor 5, other sensors 9, the REF sensing portion 21, and the cylinder identification portion 22. On the basis of these input signals, the engine control portion 23 calculates the timing of an engine operating parameter, such as the ignition timing and the fuel injection timing, and controls the engine according to the calculated timing.

Figure 5:
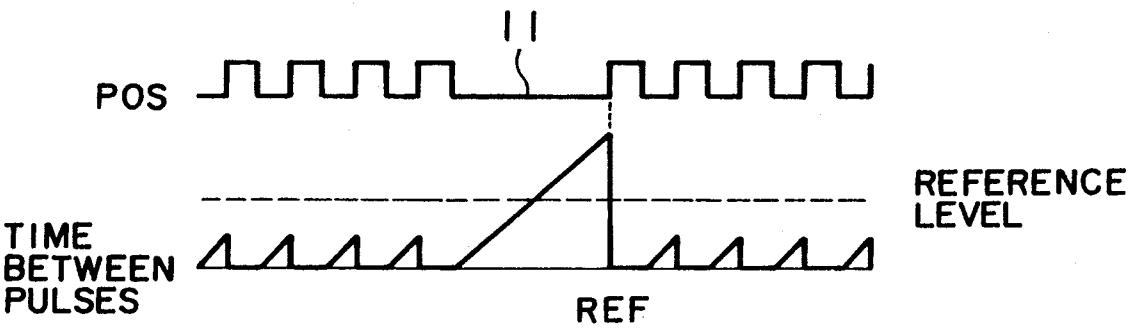
FIG. 5 is a wave form diagram illustrating how the REF position is sensed using the POS signal.

The REF position sensor 21 identifies the REF position by sensing when the interval between consecutive pulses of the POS signal is longer than a prescribed value. For example, as shown in FIG. 5, the REF position sensor 21 can include a voltage generator that generates a signal having a voltage that increases linearly with respect to time from zero volts at the falling edge of each pulses of the POS signal and then is reset to zero volts at the rising edge of the next pulse. When the voltage exceeds a prescribed reference level, it is determined that the interval being measured is one of the gaps 11 in the POS signal corresponding to one of the gaps 4*b* in the ring gear 4. The falling edge of a signal having a voltage larger than the reference level indicates the occurrence of the REF position.

Figure 6:
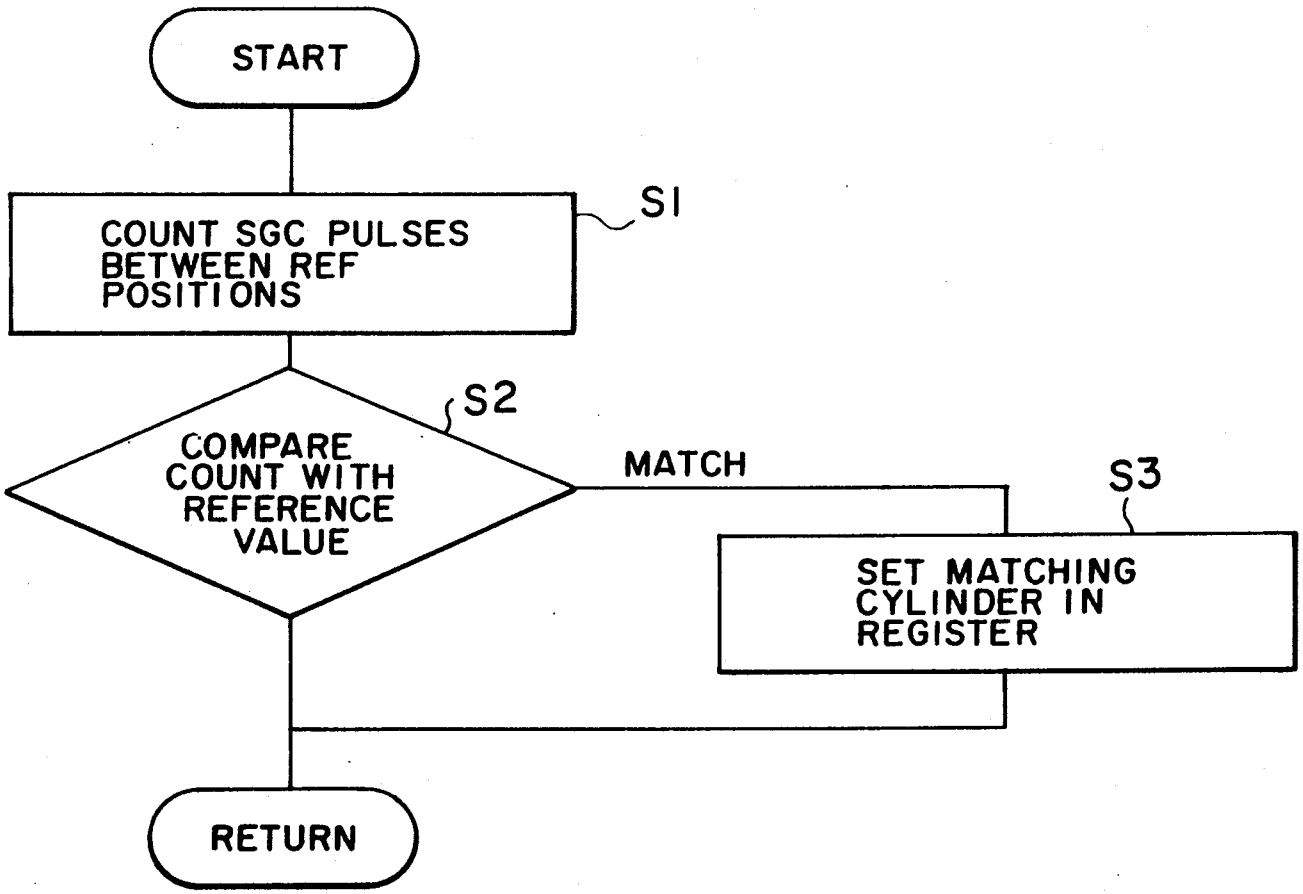
FIG. 6 is a flow chart of a routine for identifying a cylinder of the engine.

FIG. 6 illustrates a routine that can be performed by the cylinder identification portion 22 to identify the cylinders of the engine 1. In Step S1, the cylinder identification portion 22 counts the number of pulses in the SGC signal between consecutive occurrences of the REF position. In Step S2, it compares the number of pulses counted in Step S1 with a plurality of reference values stored in an unillustrated memory of the control unit 20, each of the reference values corresponding to one of the cylinders of the engine. The cylinder corresponding to the most recent pulses of the SGC signal is identified by determining which reference value equals the number of pulses counted in Step S1. In Step S3, the number of the identified cylinder is set in a memory register of the cylinder identification portion 22.

The pulses of the SGC signal are offset with respect to the REF positions by a sufficient amount such that even if slippage occurs in the transmission system connecting the crankshaft 2 and the camshaft 8, the pulses in the SGC signal will not overlap the REF positions, and the cylinders can be identified with certainty.

The engine control portion 23 calculates the ignition timing and fuel injection timing based on the current engine operating conditions as determined by the input signals from the crankshaft position sensor 5, the other sensors 9, and the REF position sensor 21. Fuel injection and ignition of the appropriate cylinder are then controlled so as to occur with the calculated timing as measured from one of the REF positions. Examples of engine operating conditions which are typically used to calculate the ignition timing and fuel injection timing are the engine rotational speed and the engine load. The engine rotational speed can be determined by measuring the length of time between consecutive occurrences of the REF position. The engine load can be determined by various parameters, such as the degree of opening of a throttle value or the air intake rate into the engine. The other sensors 9 can be chosen according to the parameters used by the engine control portion 23. Algorithms for use in calculating the timing of engine operating parameters such as the ignition timing and fuel injection timing based on inputs from external sensors are well known to those skilled in the art, so a detailed description of the engine control portion 23 will be omitted. Furthermore, the engine control portion 23 may be used to control engine operating parameters other than the timing of ignition and fuel injection.

Once calculated, the fuel injection timing and ignition timing can be measured from the REF position in terms of degrees of crankshaft rotation or in terms of time. For example, if the ignition timing is calculated to be N degrees after the occurrence of the REF position, the passage of N degrees can be determined by counting pulses of the POS signal with a counter or by using a timer to measure a length of time corresponding to N degrees of crankshaft rotation given the present engine rotational speed. Measuring the timing by counting pulses of the POS signal has the advantage that the timing can be accurately controlled even when the engine speed is fluctuating.

In the present invention, neither of sensors 5 or 8 requires high resolution, so they can both be inexpensive sensors such as electromagnetic sensors. Since the REF position, on the basis of which the timing of fuel injection and ignition are controlled, is detected directly from the crankshaft 2 rather than from the camshaft 6, it can always be detected with accuracy, even if there is slippage in the mechanical transmission system connecting the crankshaft and the camshaft. Therefore, fuel injection and ignition can always be controlled with the proper timing.

In the embodiment of FIG. 1, each of the gaps 4*b* in the ring gear 4 has the same length in the circumferential direction of the ring gear 4. However, when the cylinders of the engine are divided into banks, it is possible to make the gaps 4*b* of different lengths, each of the gaps 4*b* corresponding to a different bank of cylinders. If this is done, the banks of cylinders can be identified based on the length of the corresponding gap 4*b* and therefore the length of the corresponding gap 11 in the POS signal.

Figure 7:
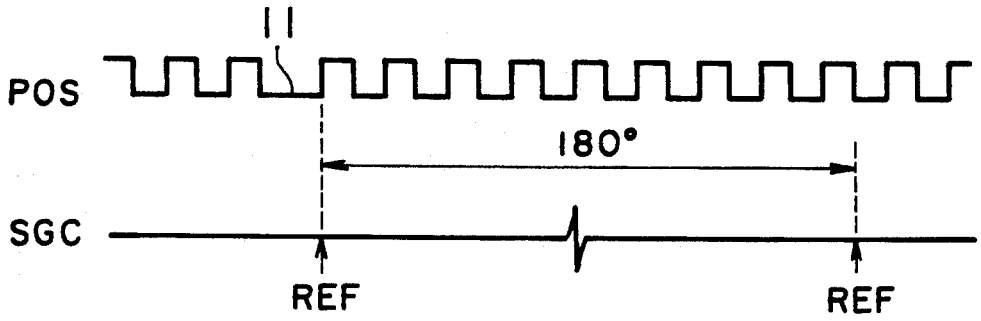
FIGS. 7 through 9 are wave form diagrams showing the output signals of the crankshaft position sensor and the camshaft position sensor according to other embodiments of the present invention.

The number of discontinuous portions in the POS signal in each rotation of the crankshaft 2 is not restricted to any particular number as long as there is at least one discontinuous portion. FIG. 7 is a wave form diagram of the POS signal and SGC signal for another embodiment of the present invention in which the POS signal has only a single discontinuous portion in the form of a gap 11 in each rotation of the crankshaft 2. The structure of this embodiment is the same as that of the embodiment of FIG. 1 except that the ring gear 4 has only one gap 4*b* formed in its periphery. The REF position sensor 21 detects a first occurrence of the REF position in each rotation of the crankshaft 2 in the manner described previously with respect to FIG. 5 by measuring the width of intervals between consecutive pulses of the POS signal. The REF position sensor 21 detects a second occurrence of the REF position by counting the pulses of the POS signal and determining when the crankshaft has rotated by a prescribed number of degrees from the first occurrence of the REF position. The prescribed number of degrees separating the first and second occurrences of the REF position will depend upon the number of cylinders in the engine. In an engine with an even number of cylinders n, the REF positions are separated by 720/n degrees of crankshaft rotation, which for a 4-cylinder engine is 720/4=180 degrees. In a 6-cylinder engine, there would be three REF positions per rotation of the crankshaft, each separated by 720/6=120 degrees of crankshaft rotation. In this case, the first occurrence of the REF position could be sensed in the manner illustrated in FIG. 5, while the second and third occurrences of the REF position in each rotation of the crankshaft could be sensed by counting pulses of the POS signal until 120 degrees and 240 degrees, respectively, of crankshaft rotation had taken place since the first occurrence of the REF position. The operation of this embodiment is otherwise the same as the embodiment of FIG. 1, and cylinders are identified by counting the number of pulses in the SGC signal between consecutive occurrences of the REF position.

Figure 8:
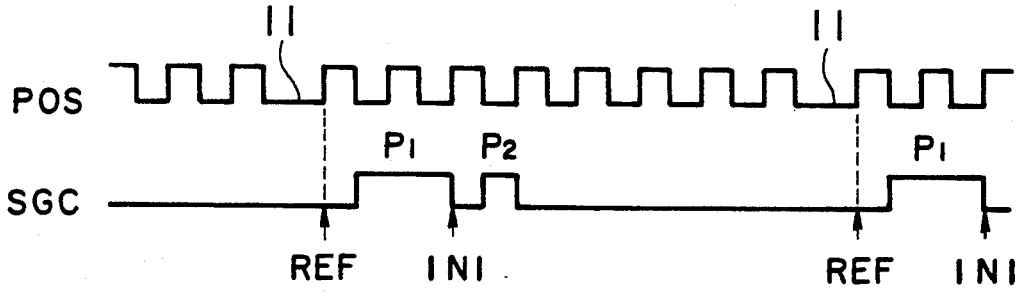

The SGC signal is not restricted to the form shown in FIG. 4. FIG. 8 is a wave form diagram of the POS signal and the SGC signal of another embodiment of the present invention. The structure of this embodiment is the same as in the preceding embodiments except that the camshaft position sensor 8 is designed so as to generate an SGC signal having a pulse train of square wave pulses of prescribed pulse width between consecutive REF positions. The number of pulses in each pulse train is varied from cylinder to cylinder so that each cylinder can be identified by counting the number of pulses in the pulse train. The first pulse in each pulse train has a prescribed pulse width P1, and any subsequent pulses in the same pulse train have a different pulse width P2. Pulses of this type can be obtained using a Hall effect sensor or an optical sensor, for example, as the camshaft position sensor 8. The rising edge of the first pulse in each pulse train occurs a prescribed number of degrees of crankshaft rotation after the REF position. The falling edge of the same pulse corresponds to a crankshaft position (referred to as the INI position) at which current begins to be supplied to an unillustrated ignition coil for the engine. The cylinder identification signal having a width P1 can be used to perform so-called bypass ignition in an unillustrated backup circuit. The operation of this embodiment is otherwise the same as that of the preceding embodiments.

The number of different types of pulses trains can be smaller than the number of cylinders. For example, there can be two different pulse trains, one of which identifies a prescribed reference cylinder, and the other of which is used for all the remaining cylinders.

Figure 9:
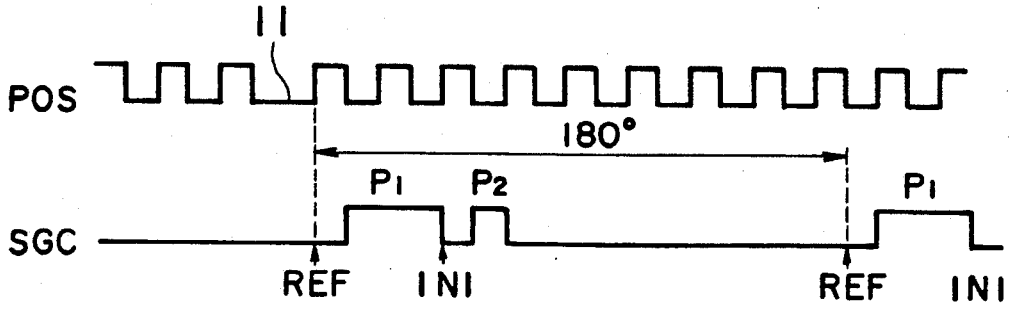

FIG. 9 illustrates the POS signal and the SGC signal of another embodiment of the present invention. The SGC signal has the same form as in the embodiment of FIG. 8, while the POS signal has the same form as in the embodiment of FIG. 7. Namely, the POS signal has one discontinuous portion in each rotation of the crankshaft 2. The first occurrence of the REF position in each rotation of the crankshaft 2 is sensed in the manner described previously with respect to FIG. 5, and the second occurrence of the REF position is sensed by counting the pulses of the POS signal and determining when the crankshaft has rotated by a prescribed number of degrees (such as 180 degrees in a 4-cylinder engine) from the first occurrence of the REF position. The operation of this embodiment is otherwise the same as the embodiment of FIG. 8.

Figure 10:
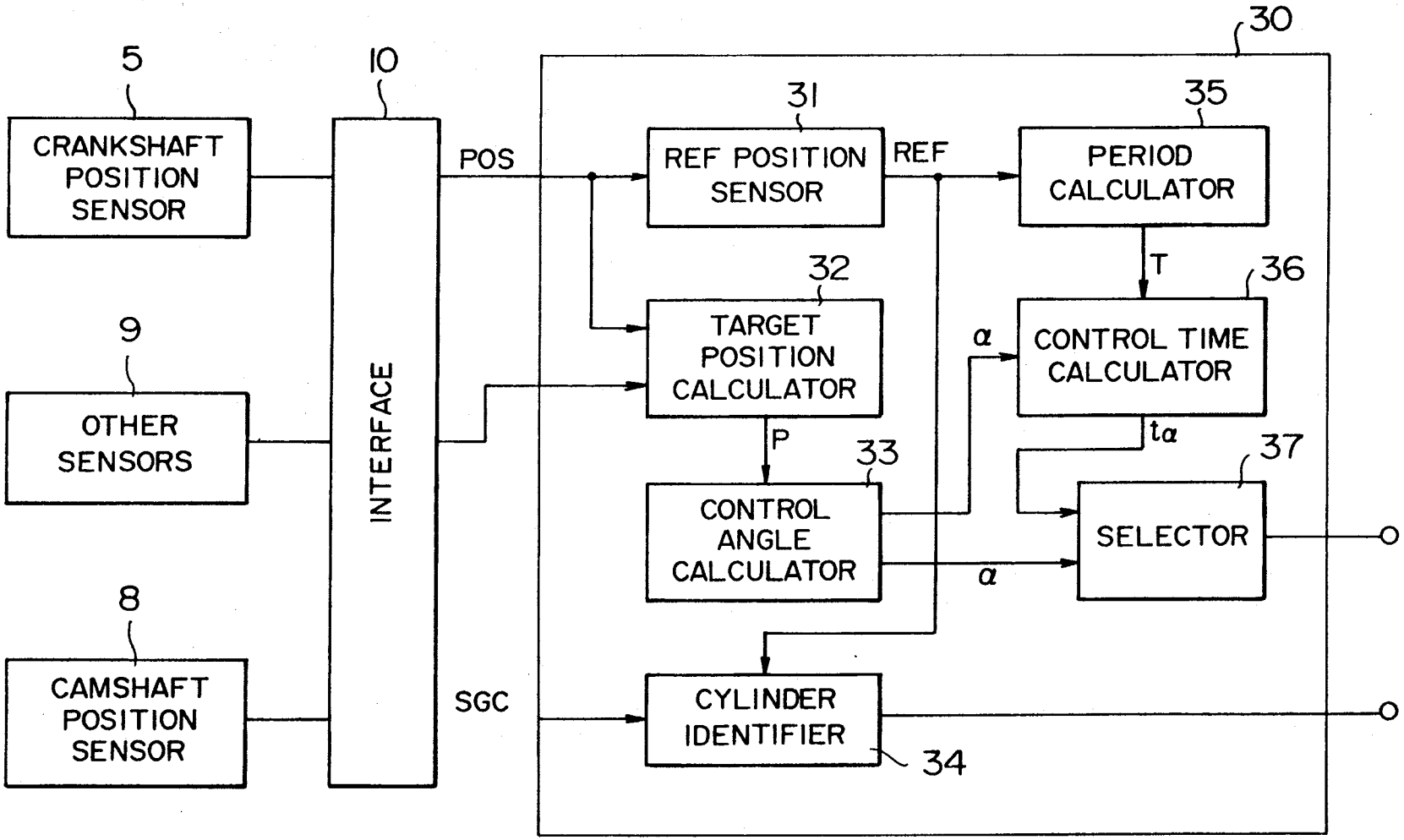
FIG. 10 is a block diagram of another embodiment of a control apparatus according to the present invention.

FIG. 10 is a block diagram of another embodiment of the present invention in which the timing of fuel injection and ignition is measured from the REF position either as a prescribed number of degrees of crankshaft rotation or as a prescribed length of time measured by a counter. The overall structure of this embodiment is similar to that of the embodiment of FIG. 1. Like that embodiment, it includes a crankshaft position sensor 5, a camshaft position sensor 8, and other sensors 9 that generate output signals which are input via an interface 10 to a control unit 30 conceptually illustrated as including elements 31–37. Preferably, the control unit 30 comprises a microcomputer. Elements 5, 8, 9, and 10 can have the same structure as in the embodiment of FIG. 1. The POS signal from the crankshaft position sensor 5 is input to a REF position sensor 31 and a target position calculator 32. The REF position sensor 31 corresponds to element 21 of FIG. 1 and generates an output signal indicating the occurrence of the REF position. The target position calculator 32 receives input signals from the crankshaft position sensor 5 and the other sensors 9 and calculates a target control position P at which a certain engine operation, such as ignition of a cylinder, is to take place. The target control position P is calculated based on the engine rotational speed, as determined by the period of the POS signal, and various other engine operating conditions sensed by the other sensors 9, such as the engine load. Algorithms that can be used by the target position calculator 3 to calculate the target control position are well known in the art, and the present invention is not limited to any particular algorithm. The target position calculator 32 generates an output signal indicating the target control position P, and this signal is input to a control angle calculator 33 which calculates a control angle $\alpha$, which equals the number of degrees of crankshaft rotation from the REF position to the target control position P. The output signal of the REF position sensor 31 is input to a period calculating portion 35, which calculates the period T between consecutive occurrences of the REF position and generates a corresponding output signal. The output signals of the control angle calculator 33 and the period calculating portion 35 are input to a control time calculator 36, which based on the period T calculates the length of time for the crankshaft to rotate by the control angle $\alpha$, assuming a constant engine rotational speed, and generates a corresponding output signal. This length of time is referred to as the control time $t_\alpha$ and in the case of a 4-cylinder engine is calculated by the formula $t_\alpha = \alpha/180 \times T$. The number in the denominator (180) equals the number of degrees of crankshaft rotation between consecutive occurrences of the REF position, and so will vary with the number of cylinders in the engine. In a 4-cycle engine with an even number of cylinders n, there are generally n/2 occurrences of the REF position per rotation of the crankshaft, so the number in the denominator is in general equal to 720/n. The output signals of the control angle calculator 33 and the control time calculator 36 are input to a selector 37, which selects whether to control the engine timing based on the control angle $\alpha$ or the control time $t_\alpha$. The output signals of the REF position sensor 31 and the camshaft position sensor 8 are input to the cylinder identification portion 34, which identifies each cylinder in the same manner as the cylinder identification portion 22 of FIG. 1 and generates an output signal indicating the cylinder which is identified.

The signal which is output by the selector 37 depends upon whether the engine rotational speed is increasing, decreasing, or substantially constant. The operation of the selector 37 will be described while referring to FIG. 11, which shows wave form diagrams of the POS signal and the SGC signal. When the selector 37 receives the control angle $\alpha$ and the control time $t_\alpha$, it selects two positions P1 and P2 such that $P1 < P \leqq P2$. P1 and P2 are chosen so that they coincide with one of the rising or falling edges of the POS signal so that the exact occurrence of P1 and P2 can be determined. Then, the selector 37 counts the number of pulses of the POS signal which have been generated and measures the length of time which has elapsed since the last occurrence of the REF position. If position P2 occurs before time $t_\alpha$ elapses, then the engine speed is increasing, so the selector 37 generates an output signal when P2 occurs, and position P2 is used as a control position for fuel injection or ignition. If time $t_\alpha$ elapses before the occurrence of position P1, then the engine speed is falling, so the selector 37 generates an output signal when position P2 is reached. If time $t_\alpha$ elapses when or after position P1 is reached and before position P2 is reached, then the engine speed is substantially constant, so the selector 37 generates an output signal when time $t_\alpha$ elapses. This operation can be summarized as follows:

Engine speed constant: Control fuel injection and ignition using control time $t_{60}$ Engine speed increasing: Control fuel injection and ignition using position P2 as a control position Engine speed decreasing: Control fuel injection and ignition using position P as a control position Thus, when the engine speed is substantially constant, the timing of fuel injection and ignition can be controlled by measuring the length of time elapsed from the REF position, and when the engine speed is fluctuating, the timing can be controlled by measuring the number of pulses of the POS signal that have been generated since the REF position. This arrangement has the advantage that when the engine speed is substantially constant, the control resolution is not restricted by the precision of the crankshaft position sensor 5 or the number of teeth in the ring gear 4. For example, if the crankshaft position sensor 5 generates pulses with a period of 2 degrees (a typical value for a crankshaft position sensor) and the occurrence of the control position P is determined by counting pulses of the POS signal from the occurrence of the REF position, in effect the control position P can only be varied in units of 2 degrees. However, if the occurrence of the control position is determined by measuring when time $t_{60}$ has elapsed, since time can be easily measured down to thousandths of a second using inexpensive equipment, the control position P can be controlled with a resolution of small fractions of a degree. Therefore, it is possible for the crankshaft position sensor 5 to be an inexpensive sensor such as an electromagnetic or Hall effect sensor and still control the timing with high resolution.

Figure 11:
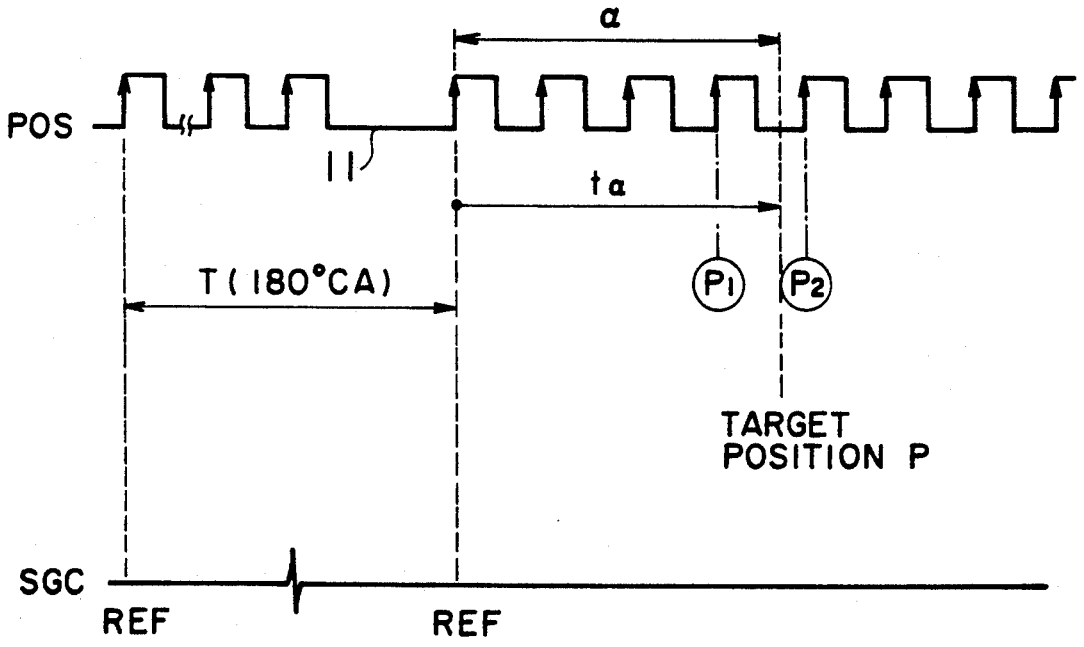
FIG. 11 is a wave form diagram of the output signals of the crankshaft position sensor and the camshaft position sensor of FIG. 10.

P1 and P2 are preferably separated by as small a number of degrees of crankshaft rotation as possible so that regardless of the engine operating state, the control position will be close to the target position P. In the embodiment of FIG. 11, for example, P1 and P2 correspond to the rising edges of consecutive pulses of the POS signal.

In the embodiment of FIG. 11, a discontinuous portion in the form of a gap 11 occurs in the POS signal n/2 times every revolution of the crankshaft (twice per revolution in the case of a four-cylinder engine), but it is possible for the discontinuous portion to occur a smaller number of times each revolution, as in the embodiments of FIG. 7. Furthermore, in the embodiment of FIG. 11, the SGC signal generated by the camshaft position sensor 8 has the same form as in the embodiment of FIG. 4, but it is possible for it to have other forms, such as the forms illustrated in FIGS. 8 and 9.

Figure 12:
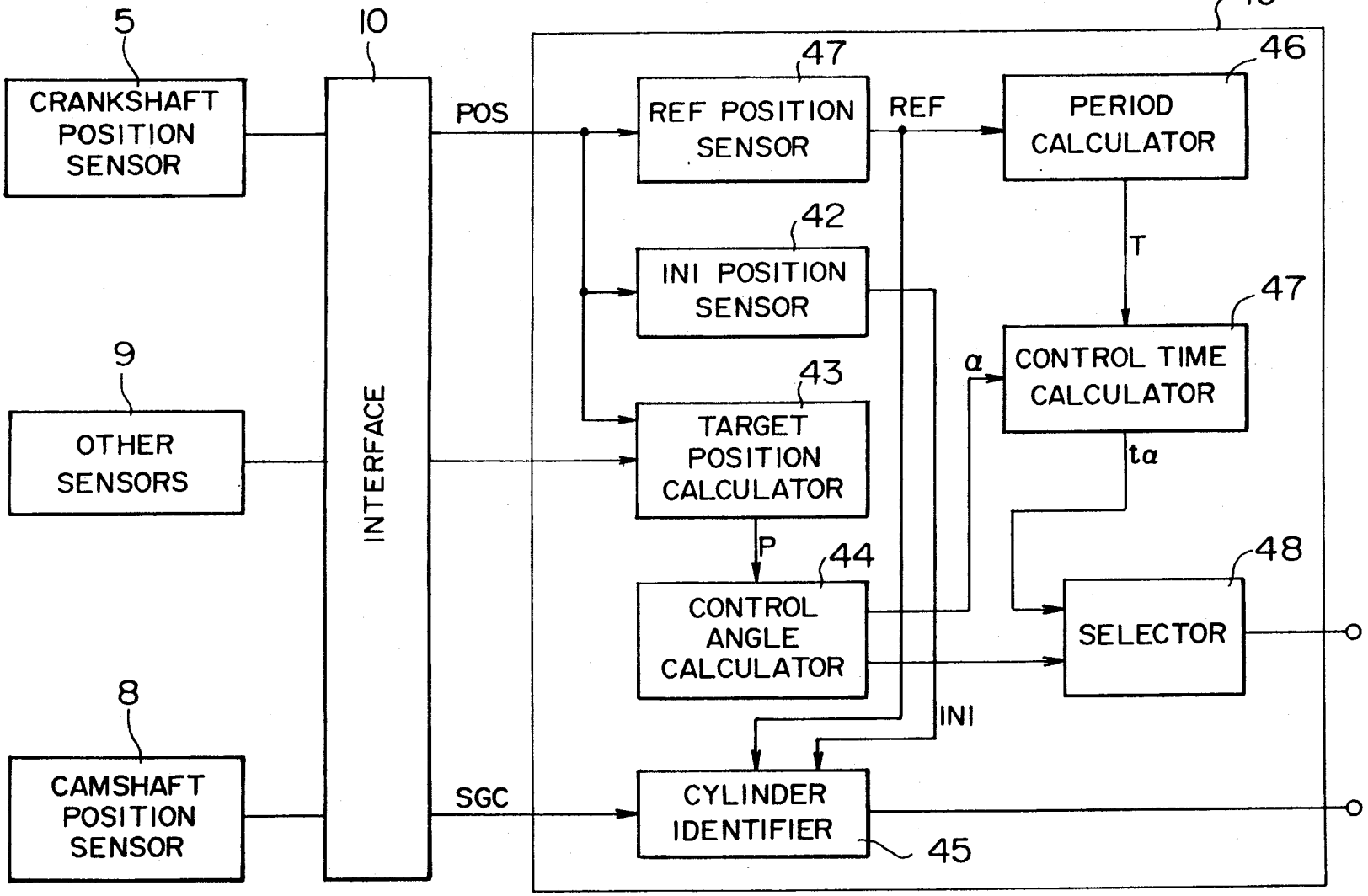
FIG. 12 is a block diagram of another embodiment of a control apparatus according to the present invention.
Figure 13:
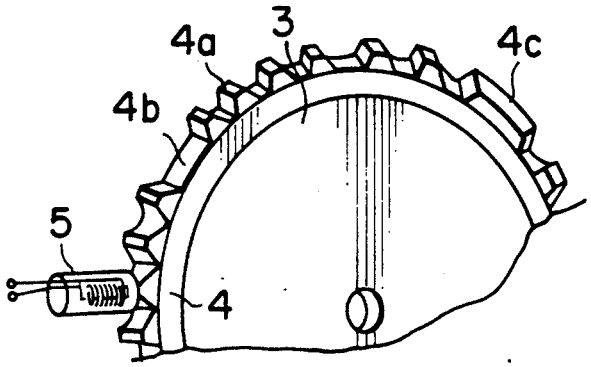
FIG. 13 is a schematic perspective view of a portion of a flywheel of an engine to which the embodiment of FIG. 12 can be applied.
Figure 14:
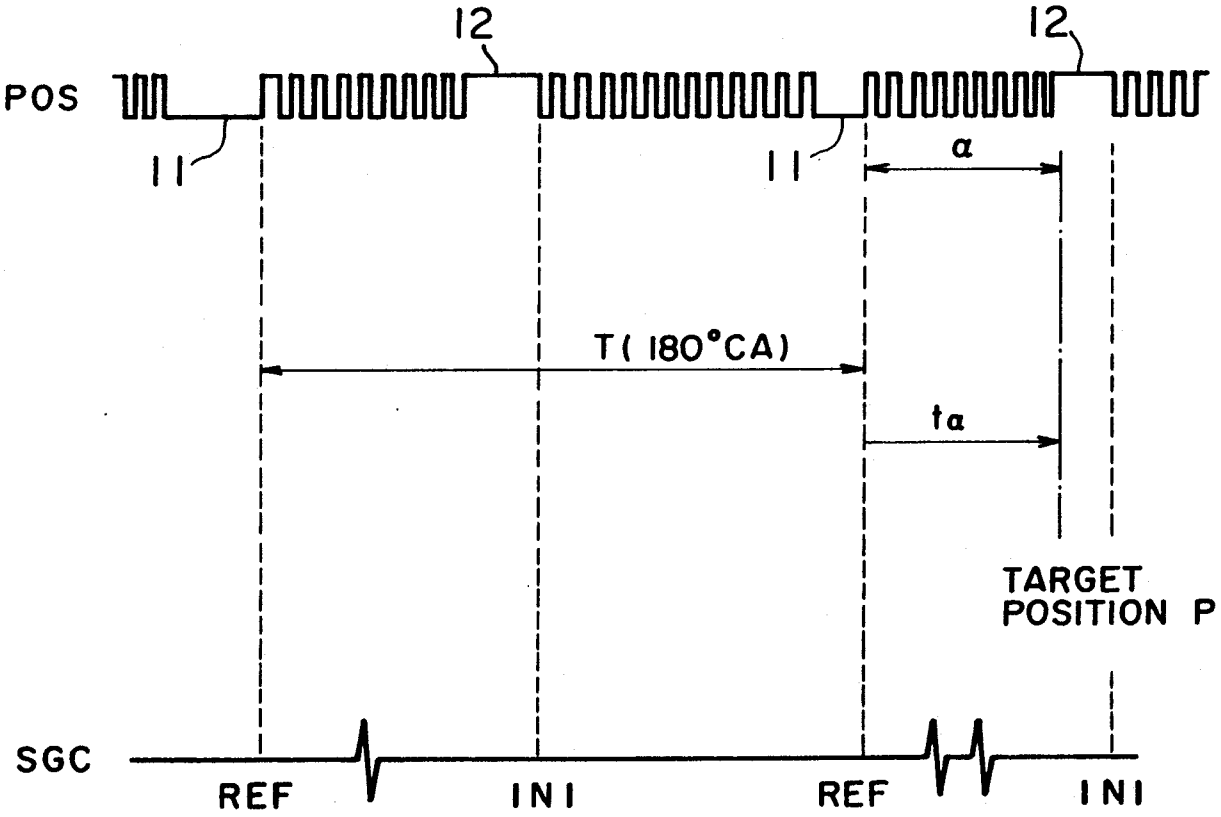
FIG. 14 is a wave form diagram of the output signals of the crankshaft position sensor and the camshaft position sensor of FIG. 12.

FIGS. 12–14 illustrate another embodiment of the present invention in which the POS signal generated by a crankshaft position sensor has first and second discontinuous portions. The first discontinuous portion corresponds to the discontinuous portion in the previous embodiments and indicates the occurrence of a first reference position of the crankshaft, which is the REF position. The second discontinuous portion is one which the POS signal has a different value from during the first discontinuous portion and indicates the occurrence of a second reference position of the crankshaft, which is the INI position at which current begins to be supplied to an unillustrated ignition coil for the engine.

FIG. 12 is a block diagram of this embodiment, FIG. 13 is a perspective view of a portion of a flywheel for use with this embodiment, and FIG. 14 is a wave form diagram of the POS signal and the SGC signal in this embodiment. The overall structure of this embodiment is similar to that of the previous embodiments. As shown in FIG. 12, it includes a crankshaft position sensor 5, a camshaft position sensor 8, and other sensors 9 which provide input signals to a control unit 40 via an interface 10. The camshaft position sensor 5 is identical to that used in the previous embodiments and senses the movement of teeth 4a on a ring gear 4 mounted on a flywheel 3. However, the ring gear 4 in FIG. 13 differs from the ring gear 4 of FIG. 3 in that in addition to having a plurality of gaps 4b between normal teeth 4a, it has a plurality of elongated teeth 4c disposed at uniform intervals around the periphery of the ring gear 4 and separated from the gaps 4b. The length of each elongated tooth 4c is greater than that of the usual teeth 4a, and the number of elongated teeth 4c is equal to the number of gaps 4b. The crankshaft position sensor 5 is disposed in the vicinity of the ring gear 4, and when the crankshaft rotates, the crankshaft position sensor 5 generates an output signal like that shown in FIG. 14 having first discontinuous portions in the form of gaps 11 corresponding to the gaps 4b in the ring gear 4 and second discontinuous portions in the form of elongated pulses 12 corresponding to the elongated teeth 4c in the ring gear 4. The POS signal has a low level during the first discontinuous portions and a high level during the second discontinuous portions, but the polarities can be reversed. The lengths of the first and second discontinuous portions are not critical, as long as the length of the first discontinuous portions is different from the normal gap between consecutive pulses of the POS signal and as long as the length of the second discontinuous portions is different from the normal pulse width of the pulses. The elongated teeth 4c are positioned on the ring gear 4 such that the falling edge of each of the elongated pulses 12 corresponds to the occurrence of the INI position. In the present embodiment, in each rotation of the crankshaft, there are n/2 occurrences of the first discontinuous portions and n/2 occurrences of the second discontinuous portions, where n is the number of cylinders in the engine.

The camshaft position sensor 8 and the other sensors 9 can be similar to those used in the embodiment of FIG. 1. However, in this embodiment, the rotating disk 7 is mounted on the camshaft 6 of the engine such that pulses in the SGC signal occur between the occurrence of a REF position and the next occurrence of an INI position. The reason for arranging the SGC pulses so as to fall during this period is so as to avoid certain crankshaft angles in which there is a high noise level and a higher probability of mistaken sensing of the pulses of the SGC signal.

The control unit 40, which preferably comprises a microcomputer, is conceptually illustrated as including elements 41–48. The POS signal from the crankshaft position sensor 5 is input to a REF position sensor 41, an INI position sensor 42, and a target position calculator 43. The REF position sensor 41 and the target position calculator 43 correspond to elements 31 and 32, respectively, of FIG. 10 and operate in the same manner. The INI position sensor 42 senses each occurrence of the INI position and generates a corresponding output signal. The INI position sensor 42 can sense the INI position by a method similar to that used by the REF position sensor 41 to sense the REF position. Namely, it can measure the pulse width of each pulse in the POS signal and sense the occurrence of a second discontinuous portion in the POS signal when the pulse width exceeds a prescribed value. The falling edge of an elongated pulse 12 indicates the INI position. The control angle calculator 44 corresponds to the control angle calculator 33 of FIG. 10 and calculates the angle $\alpha$ measured in degrees of crankshaft rotation from the REF position to the target control position P determined by the target position calculator 43. The period calculating portion 46 corresponds to the period calculating portion 35 of FIG. 10 and calculates the length T of the period between consecutive occurrence of the REF position. The cylinder identification portion 45 receives the output signals of the camshaft position sensor 8, the REF position sensor 41, and the INI position sensor 42. It operates in a manner similar to the cylinder identification portion 34 of FIG. 10 except that it identifies cylinders by counting the number of pulses in the SGC signal between the occurrence of a REF position and the occurrence of the subsequent INI position. It then generates an output signal identifying a cylinder. The control time calculator 47 corresponds to the control time calculator 36 of FIG. 10 and calculates a control time $t_\alpha$ equal to the length of time required for the crankshaft to rotate by the control angle $\alpha$ assuming a constant engine rotational speed. The output signals of the control angle calculator 44 and the control time calculator 47 are input to a selector 48, which operates in the same manner as the selector 37 of FIG. 10 and generates an output signal for controlling the timing of fuel injection or ignition based on either the control angle $\alpha$ or the control time $t_\alpha$. This embodiment provides the same advantages as the previous embodiments.

Figure 15:
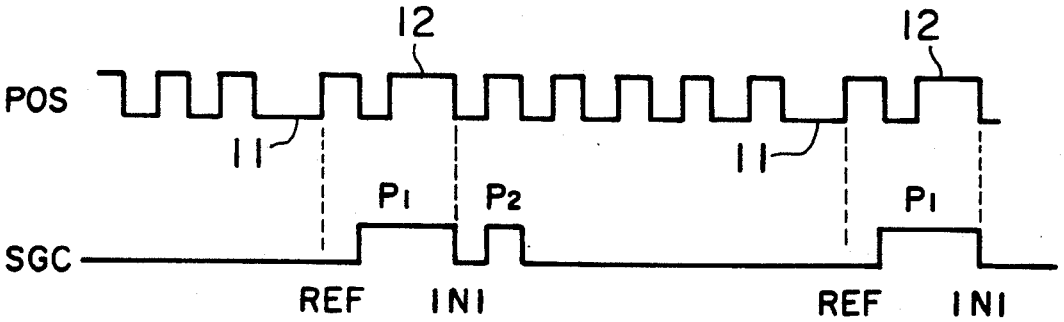
FIG. 15 is a wave form diagram of the output signals of the crankshaft position sensor and the camshaft position sensor of another embodiment of the present invention.

In the embodiment of FIGS. 12–14, a first and second discontinuous portion in the POS signal each occur n/2 times every revolution of the crankshaft (twice per revolution in the case of a four-cylinder engine), but it is possible for the discontinuous portions to occur a smaller number of times each revolution, as in the embodiment of FIG. 7. Furthermore, in the embodiment of FIGS. 12–14, the SGC signal generated by the camshaft position sensor 8 has the same form as in the embodiment of FIG. 4, but it is possible for it to have other forms. FIG. 15 is a wave form diagram of the POS signal and the SGC signal of another embodiment of the present invention in which the SGC signal has a form like that illustrated in FIG. 8. Namely, the SGC signal comprises a pulse train of square wave pulses of prescribed pulse width between consecutive REF positions. The number of pulses in each pulse train varies so that the cylinders can be identified by counting the number of pulses in the pulse train. The first pulse in each pulse train has a pulse width P1, and any subsequent pulses in the same pulse train have a different pulse width P2. The rising edge of the first pulse in each pulse train occurs a prescribed number of degrees of crankshaft rotation after the REF position, and the falling edge of the same pulse coincides with the INI position. This embodiment is otherwise the same as the preceding embodiment.

What is claimed is:

1. A control apparatus for an engine comprising:

a crankshaft position sensing means for sensing the rotation of a crankshaft of an engine and generating an output signal indicating the rotation of the crankshaft, the output signal having a first discontinuous portion corresponding to a reference position of the crankshaft;

timing calculating means for calculating the timing for an operating parameter of the engine based on the operating state of the engine;

position sensing means for sensing the rotation of a member rotating at half the speed of the crankshaft and generating a cylinder identification signal each time the member is at a prescribed position, the cylinder identification signal identifying a cylinder of the engine and being generated between consecutive occurrences of the reference position of the crankshaft; and parameter control means for controlling the operating parameter with respect to the cylinder identified by the cylinder identification signal according to the calculated timing using the reference position as a reference.

2. A control apparatus as claimed in claim 1 wherein the first discontinuous portion occurs a plurality of times each rotation of the crankshaft.

3. A control apparatus as claimed in claim 1 wherein the engine is equipped with n cylinders, and the first discontinuous portion occurs n/2 times each rotation of the crankshaft.

4. A control apparatus as claimed in claim 1 wherein the first discontinuous portion occurs only one time each rotation of the crankshaft.

5. A control apparatus as claimed in claim 1 wherein the output signal of the crankshaft position sensing means comprises a series of pulses separated by intervals of a first length, and the first discontinuous portion comprises a gap between consecutive pulses, the gap having a length different from the first length.

6. A control apparatus as claimed in claim 1 wherein the output signal of the crankshaft position sensing means comprises a series of pulses having a first pulse width, and the first discontinuous portion comprises a pulse having a pulse width different from the first pulse width.

7. A control apparatus as claimed in claim 1 wherein the crankshaft position sensing means comprises:

a ring gear secured to the engine for rotation with the crankshaft, the ring gear having a plurality of teeth separated by intervals of a first length and having a gap between adjacent teeth with a length different from the first length; and a sensor disposed in the vicinity of the ring gear for generating an electrical signal in response to movement of the teeth.

8. A control apparatus as claimed in claim 1 wherein the crankshaft position sensing means comprises:

a ring gear secured to the engine for rotation with the flywheel, the ring gear having a plurality of first teeth and a second tooth having a length different from the first teeth; and a sensor disposed in the vicinity of the ring gear for generating an electrical signal in response to movement of the teeth.

9. A control apparatus as claimed in claim 1 wherein the position sensing means comprises a camshaft position sensor for sensing the rotational position of a camshaft of the engine.

10. A control apparatus as claimed in claim 1 wherein the output signal of the crankshaft position sensing means comprises a second discontinuous portion corresponding to a second reference position of the crankshaft.

11. A control apparatus as claimed in claim 10 wherein the output signal has a different level in the first discontinuous portion than in the second discontinuous portion.

12. A control apparatus as claimed in claim 10 wherein the second reference position is a position of the crankshaft at which it is suitable to begin supply of current to an ignition coil for the engine.

13. A control apparatus as claimed in claim 10 wherein the output signal of the position sensing means is generated between an occurrence of the first reference position and an immediately succeeding occurrence of the second reference position.

14. A control apparatus as claimed in claim 1 wherein the parameter control means comprises:

angle calculating means for calculating a control angle in degrees of crankshaft rotation from the reference position to a control position corresponding to the calculated timing;

control time calculating means for calculating a control time required for the crankshaft to rotate at the current rotational speed of the engine from the reference position to the control position; and selecting means for selecting either the control angle or the control time in accordance with an operating condition of the engine and controlling the engine parameter based on the selected control angle or control time.

15. A control apparatus as claimed in claim 1, wherein the control parameter is the timing of supply of fuel to the engine.

16. A control apparatus as claimed in claim 1, wherein the control parameter is the timing of ignition of a cylinder of the engine.

17. A control method for an engine comprising:

sensing the rotation of a crankshaft of an engine and generating an output signal indicating the rotation of the crankshaft, the output signal having a first discontinuous portion corresponding to a reference position of the crankshaft;

calculating the timing for an operating parameter of the engine based the operating state of the engine;

sensing the rotation of a member rotating at half the speed of the crankshaft and generating a cylinder identification signal each time the member is at a prescribed position, the cylinder identification signal identifying a cylinder of the engine and being generated between consecutive occurrences of the reference position of the crankshaft; and controlling the operating parameter with respect to the cylinder identified by the cylinder identification signal according to the calculated timing using the reference position as a reference.

* * * * *